US010916893B2

(12) United States Patent
Nguyen

(10) Patent No.: US 10,916,893 B2
(45) Date of Patent: Feb. 9, 2021

(54) CROSSTALK SHIELD

(71) Applicant: ITT MANUFACTURING ENTERPRISES LLC, Wilmington, DE (US)

(72) Inventor: Hong Nguyen, Stanton, CA (US)

(73) Assignee: ITT MANUFACTURING ENTERPRISES LLC, Wilmington, DE (US)

( * ) Notice: Subject to any disclaimer, the term of this patent is extended or adjusted under 35 U.S.C. 154(b) by 0 days.

(21) Appl. No.: 16/451,659

(22) Filed: Jun. 25, 2019

(65) Prior Publication Data

US 2020/0412064 A1 Dec. 31, 2020

(51) Int. Cl.

| | |
|---|---|
| ***H01R 13/6585*** | (2011.01) |
| ***H01R 13/6598*** | (2011.01) |
| ***H01R 13/502*** | (2006.01) |
| ***H01R 13/6593*** | (2011.01) |
| ***H01R 43/20*** | (2006.01) |
| ***H01R 24/86*** | (2011.01) |

(52) U.S. Cl.

CPC ..... *H01R 13/6585* (2013.01); *H01R 13/502* (2013.01); *H01R 13/6593* (2013.01); *H01R 13/6598* (2013.01); *H01R 24/86* (2013.01); *H01R 43/20* (2013.01)

(58) Field of Classification Search

CPC ..... H01R 13/6585; H01R 13/502; H01R 13/6593; H01R 13/6598; H01R 24/86; H01R 43/20; H01R 9/0518

USPC ..... 439/607.05, 585, 578

See application file for complete search history.

(56) References Cited

U.S. PATENT DOCUMENTS

| | | | | |
|---|---|---|---|---|
| 7,195,518 | B2 * | 3/2007 | Bert | H01R 4/2441 439/290 |
| 7,316,584 | B2 * | 1/2008 | Mackillop | H01R 13/6463 439/607.05 |
| 9,236,688 | B2 * | 1/2016 | Friedhof | H01R 13/6461 |
| 9,257,796 | B1 * | 2/2016 | Dang | H01R 9/035 |
| 9,306,312 | B2 * | 4/2016 | Dang | H01R 13/6586 |
| 9,728,902 | B2 * | 8/2017 | Hoher | H01R 9/038 |
| 10,355,379 | B1 * | 7/2019 | Lewis | H01R 9/0518 |

* cited by examiner

*Primary Examiner* — Hien D Vu

(74) *Attorney, Agent, or Firm* — Hertzberg, Turk & Associates, LLC

(57) ABSTRACT

Technologies are described for devices and methods to prevent crosstalk. The devices may comprise a first and a second electromagnetic interference shield, each effective to prevent crosstalk between inner contacts and each may include a first flat plate and a second flat plate connected at a bend. The device may comprise an inner insulator. The inner insulator may include walls defining slots configured to receive the first and second electromagnetic interference shields and walls defining cavities configured to secure inner contacts to the inner insulator. The device may comprise the inner contacts and an outer insulator. The outer insulator may be configured to slide over and attach to the inner insulator. The device may comprise a ferrule and an outer body. The outer body may be configured to enclose the outer insulator, the inner insulator, the inner contacts, the electromagnetic interference shields, and at least part of the ferrule.

17 Claims, 6 Drawing Sheets

700

800

CROSSTALK SHIELD

BACKGROUND

Unless otherwise indicated herein, the materials described in this section are not prior art to the claims in this application and are not admitted to be prior art by inclusion in this section.

Network cables transfer data in various environments. Crosstalk may be electromagnetic interference between pairs of wires within a cable. Pairs of wires may be run parallel to each other and signals traveling through adjacent pairs of wires may interfere with each other. Shielding may be used to prevent or reduce crosstalk between pairs of wires within a cable.

SUMMARY

One embodiment of the invention is a device to prevent crosstalk. The device may comprise a first electromagnetic interference shield and a second electromagnetic interference shield. Each electromagnetic interference shield may be effective to prevent crosstalk between inner contacts and may include a first flat plate and a second flat plate connected at a bend. The device may comprise an inner insulator. The inner insulator may include walls defining slots configured to receive the first and second electromagnetic interference shields. The inner insulator may include walls defining cavities configured to secure inner contacts to the inner insulator. The device may comprise the inner contacts. The device may comprise an outer insulator. The outer insulator may be configured to slide over and attach to the inner insulator. The device may comprise a ferrule. The device may comprise an outer body. The outer body may be configured to enclose the outer insulator, the inner insulator, the inner contacts, the electromagnetic interference shields, and at least part of the ferrule.

Another embodiment of the invention includes a system to prevent crosstalk. The system may comprise a first electromagnetic interference shield and a second electromagnetic interference shield. Each electromagnetic interference shield may be effective to prevent crosstalk between inner contacts and may include a first flat plate and a second flat plate connected at a bend. The system may comprise an inner insulator. The inner insulator may include walls defining slots configured to receive the first and second electromagnetic interference shields. The inner insulator may include cavities configured to secure inner contacts to the inner insulator. The system may comprise the inner contacts. The inner contacts may be attached to wires from a cable. The system may comprise the cable. The system may comprise an outer insulator. The outer insulator may be configured to slide over and attach to the inner insulator. The system may comprise a ferrule. The ferrule may be crimped to a shielding braid of the cable and an outer body. The system may comprise the outer body. The outer body may be configured to enclose the outer insulator, the inner insulator, the inner contacts, the electromagnetic interference shields, and at least part of the ferrule.

Another embodiment of the invention is a method to prevent crosstalk. The method may comprise placing a ferrule over a cable shielding braid of a cable. The cable shielding braid may be folded over the ferrule to expose wires from within the cable. The method may comprise attaching the wires from within a cable to inner contacts. The method may comprise inserting the inner contacts into cavities of an inner insulator. The cavities may be configured to secure the inner contacts to the inner insulator. The inner insulator may include slots with a first electromagnetic interference shield and a second electromagnetic interference shield within the slots. The method may comprise attaching an outer insulator to the inner insulator. The method may comprise enclosing the outer insulator, the inner insulator, the inner contacts, the first and second electromagnetic interference shields, and at least part of the ferrule with an outer body. The method may comprise crimping the outer body to the cable shielding braid and the ferrule.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE FIGURES

The foregoing and other features of this disclosure will become more fully apparent from the following description and appended claims, taken in conjunction with the accompanying drawings. Understanding that these drawings depict only several embodiments in accordance with the disclosure and are, therefore, not to be considered limiting of its scope, the disclosure will be described with additional specificity and detail through use of the accompanying drawings, in which:

DETAILED DESCRIPTION

Figure 1:
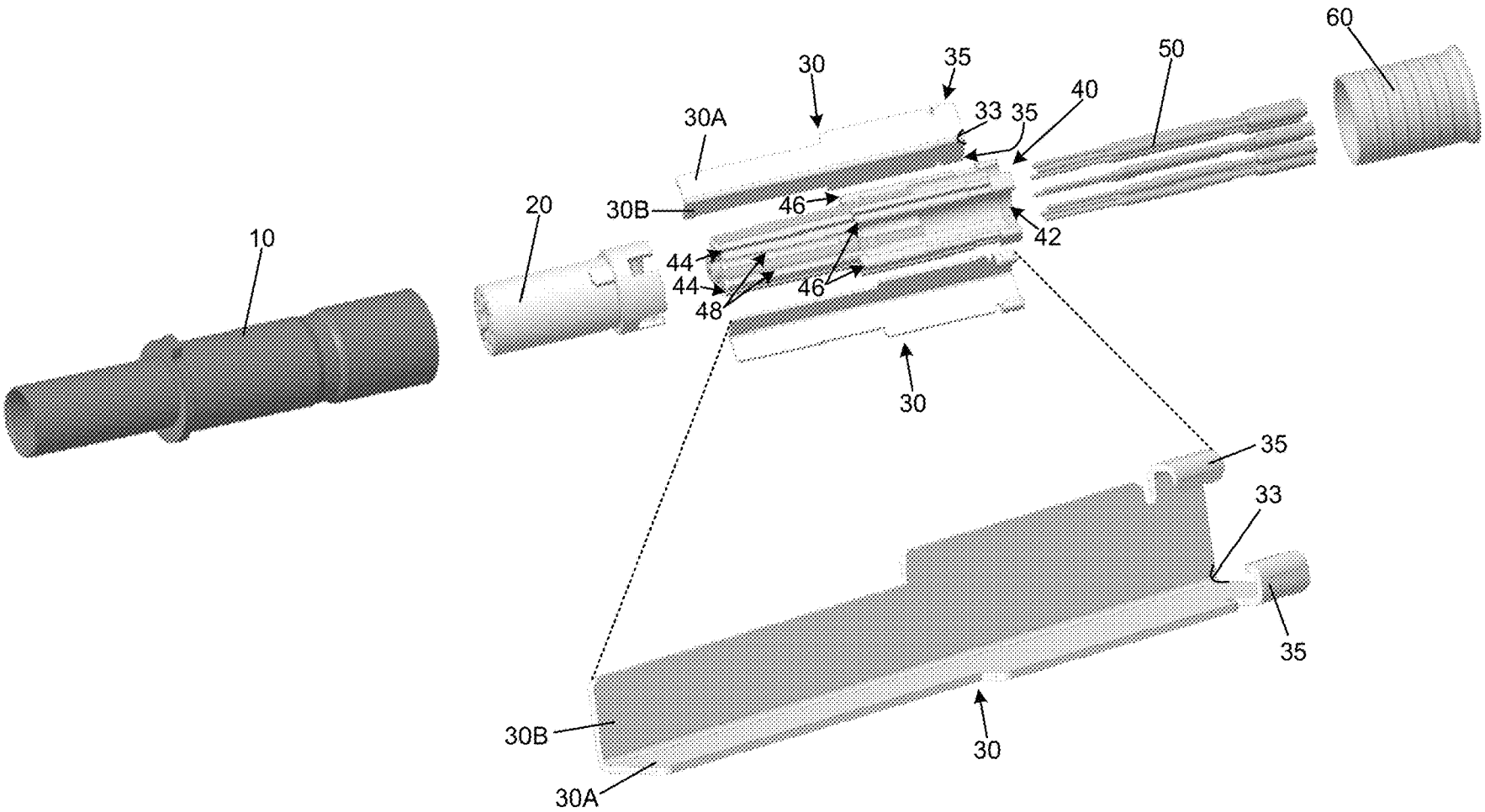
FIG. 1 is a side perspective exploded view of a crosstalk shield system.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the Figures, can be arranged, substituted, combined, separated, and designed in a wide variety of different configurations, all of which are explicitly contemplated herein.

Figure 2:
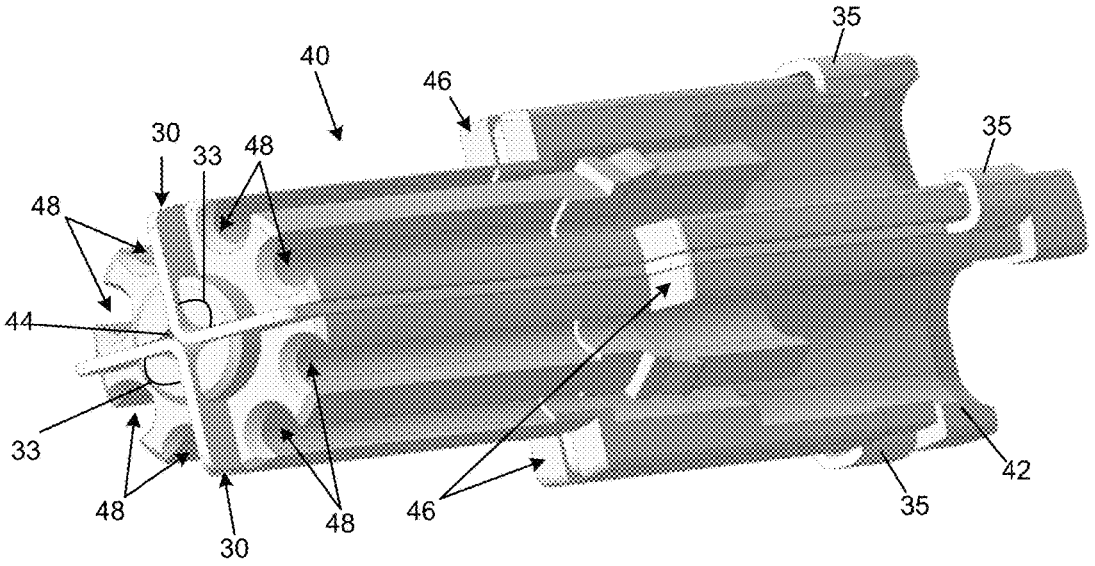
FIG. 2 is a side perspective view of an inner insulator with electromagnetic interference shields within the inner insulator.

FIG. 1 is a side exploded perspective view of a crosstalk shield system 100, arranged in accordance with at least some embodiments described herein. FIG. 2 is a side view of an inner insulator with electromagnetic interference shields inserted within the inner insulator, arranged in accordance with at least some embodiments described herein. System 100 may include a pin contact outer body 10, an outer insulator 20, electromagnetic interference (EMI) shields 30, an inner insulator 40, inner pin contacts 50, and a ferrule 60. Pin contact outer body 10 may be metal, beryllium copper, or copper alloy. Outer insulator 20 may be plastic. EMI shield plates 30 may be stainless steel, beryllium copper, or copper alloy. Inner insulator 40 may be plastic or any other insulator material. Inner pin contacts 50 may be metal, beryllium copper, or copper alloy. Ferrule 60 may be metal.

System 100 may include two EMI shields 30. Each EMI shield 30 may include an essentially flat first plate 30A and an essentially flat second plate 30B. First plate 30A may be connected to second plate 30B at a bend with an angle 33 and may form a V shape. Angle 33 may be around 90 degrees such that first plate 30A is essentially perpendicular to second plate 30B. Each EMI shield 30 may include a hook 35A at a first end of first plate 30A and a hook 35B at a first end of second plate 30B. Hooks 35 may curve in towards angle 33.

Focusing on FIG. 2, inner insulator 40 may include an essentially cylindrically shaped base body. A first end of inner insulator 40 may include a solid end cap 42. Inner insulator 40 may define slots 44, tabs 46, and cavities 48. Inner insulator may include walls that define four slots 44, four tabs 46, and eight cavities 48. Slots 44 may be defined as radial openings from a center axis of inner insulator 40 to an opening on a surface of inner insulator 40. Slots 44 may bisect tabs 46. Slots 44 may further run axially through the body of inner insulator 40 from solid end cap 42 to the second end of inner insulator 40 and may divide the body of inner insulator 40 into quadrants. Cavities 48 may be configured to secure inner pin contacts 50 to inner insulator 40 when inner pin contacts 50 are inserted into cavities 48. Cavities 48 may be configured to secure two inner pin contacts 50 to inner insulator 40 between each tab 46. As explained in more detail below, EMI shield plates 30 placed within slots 44 of inner insulator 40 may prevent crosstalk between pairs of wires connected to inner pin contacts 50 secured to inner insulator 40.

As shown in FIG. 2, slots 44 may begin at a central axis of inner insulator 40 and divide body of inner insulator 40 into four quadrants. Slots 44 may be configured to receive EMI shields 30. Slots 44 may be configured so that two EMI shields 30 may be placed within slots 44 of inner insulator 40. EMI shields 30 may be placed within slots 44 with angle 33 of first EMI shield 30 opposite angle 33 of second EMI shield 30. First end of plate 30A and first end of plate 30B with hooks 35 may be in contact with end cap 42 of inner insulator 40 when EMI shields 30 are placed within slots 44 of inner insulator 40. Hooks 35 of EMI shields 30 may be positioned over indentations within tabs 46 of inner insulator 40 when EMI shields 30 are placed within slots 44 of inner insulator 40. EMI shields 30 within slots 44 may bisect tabs 46.

Figure 3:
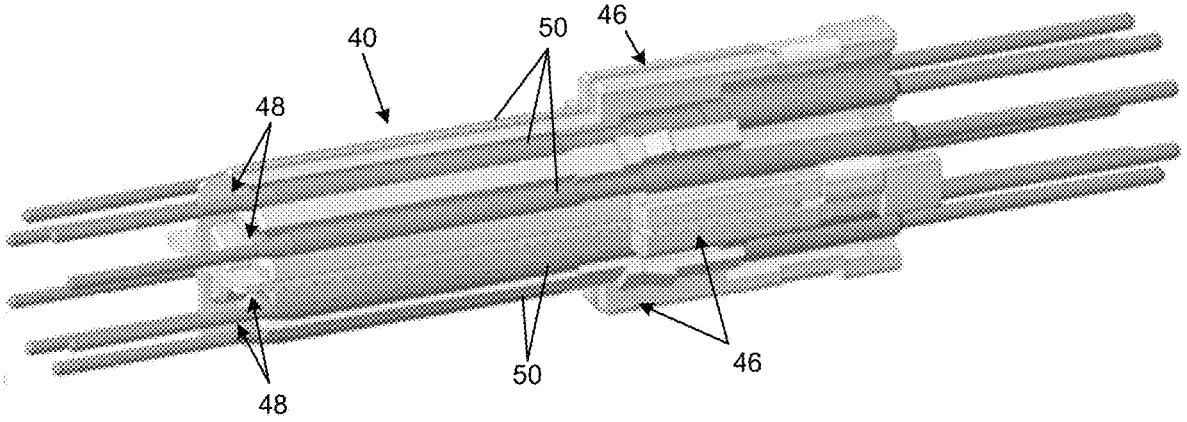
FIG. 3 is a side perspective view of pin contacts secured to an inner insulator with electromagnetic interference shields within the inner insulator.

FIG. 3 is a side view of pin contacts secured to an inner insulator with electromagnetic interference shields within the inner insulator, arranged in accordance with at least some embodiments described herein. Those components in FIG. 3 that are labeled identically to components of FIGS. 1-2 will not be described again for the purposes of brevity.

As shown in FIG. 3, cavities 48 may secure inner pin contacts 50 to inner insulator 40. Inner pin contacts 50 may snap into cavities 48 and be secured by friction to inner insulator 40. Two paired inner pin contacts 50 may be secured to inner insulator 40 between each tab 46. EMI shields 30 within inner insulator 40 may be situated between and separate the pairs of inner pin contacts 50. EMI shields 30 between pairs of inner pin contacts 50 may prevent crosstalk between pairs of wires connected to the pairs of inner pin contacts 50.

Figure 4:
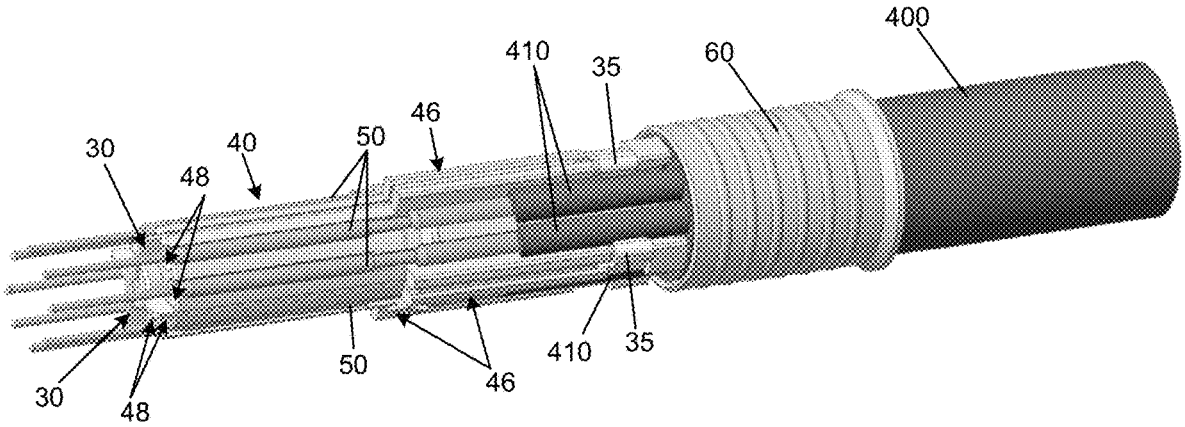
FIG. 4 is a side perspective view of a ferrule and a cable attached to pin contacts secured to an inner insulator.

FIG. 4 is a side view of a ferrule and a cable attached to pin contacts secured to an inner insulator, arranged in accordance with at least some embodiments described herein. Those components in FIG. 4 that are labeled identically to components of FIGS. 1-3 will not be described again for the purposes of brevity.

A cable 400 may include twisted cable pairs of wires 410. As shown in FIG. 4, wires 410 from a cable 400 may be attached to inner pin contacts 50 on a one to one basis. An untwisted cable pair of wires 410 may be attached to each pair of inner pin contacts 50 and each inner pin contact 50 may be secured within a cavity 48 of inner insulator 40. EMI shields 30 within inner insulator 40 may be between and separate the pairs of inner pin contacts 50 and respective untwisted cable pairs of wires 410 from cable 400. EMI shields 30 between pairs of inner pin contacts 50 may prevent electromagnetic interference and crosstalk between untwisted cable pairs of wires 410 from cable 400 connected to the pairs of inner pin contacts 50. Ferrule 60 may be placed over and crimped to a shielding braid of cable 400.

Figure 5:
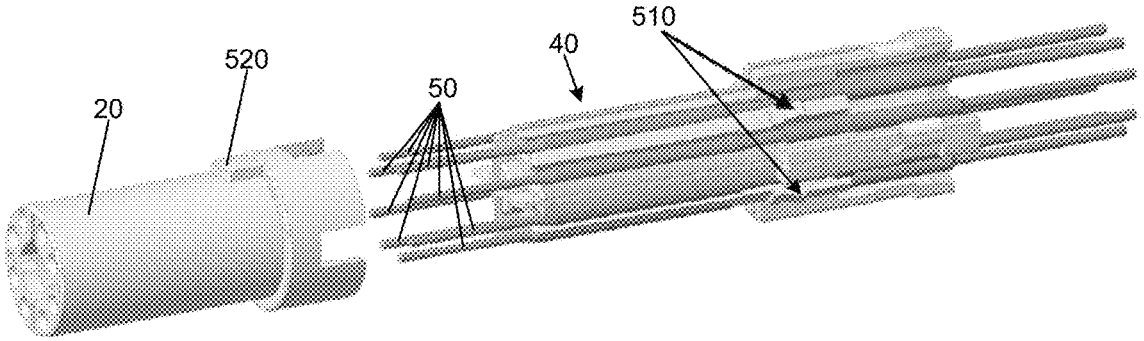
FIG. 5 is a side perspective view of an outer insulator and an inner insulator attached to contact pins.

FIG. 5 is a side view of an outer insulator and an inner insulator attached to contact pins, arranged in accordance with at least some embodiments described herein. Those components in FIG. 5 that are labeled identically to components of FIGS. 1-4 will not be described again for the purposes of brevity.

Outer insulator 20 may be configured to slide over and attach to inner insulator 40. Inner insulator 40 may include outer insulator fasteners 510. Inner insulator 40 may include four outer insulator retention ribs 510. Outer insulator retention ribs 510 may be configured to secure outer insulator 20 to inner insulator 40. Outer insulator retention ribs 510 may be projections such as clips, and outer insulator retention ribs 510 may depress when outer insulator 20 slides over inner insulator 40. Outer insulator retention ribs 510 may engage with outer insulator 20 to secure outer insulator 20 to inner insulator 40. Outer insulator 20 may include an insulator alignment key 520. Insulator alignment key 520 may align with a tab 46 of inner insulator 40. Inner pin contacts 50 may be secured to cavities 48 and inner insulator 40 with epoxy.

Figure 6:
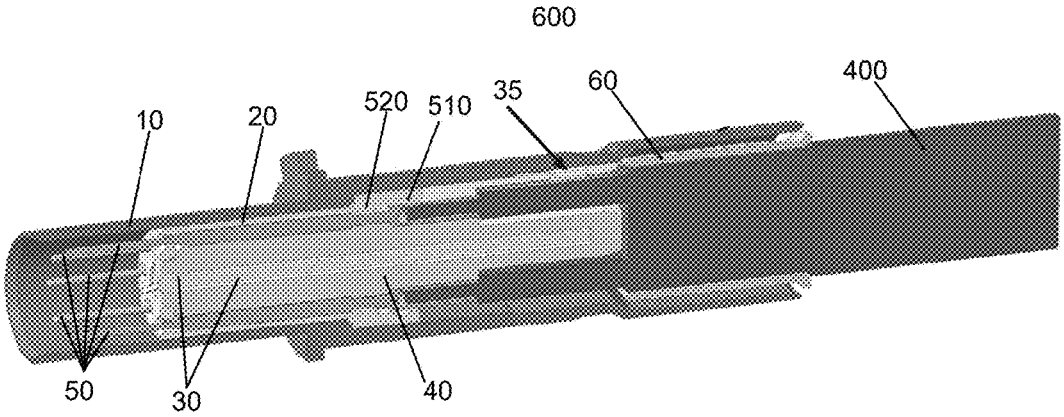
FIG. 6 is a side cutout perspective view of a crosstalk shield system.

FIG. 6 is a side cutout view of a crosstalk shield system, arranged in accordance with at least some embodiments described herein. Those components in FIG. 6 that are labeled identically to components of FIGS. 1-5 will not be described again for the purposes of brevity.

System 600 may include pin contact outer body 10, outer insulator 20, electromagnetic interference (EMI) shields 30, inner insulator 40, inner pin contacts 50, ferrule 60, and cable 400. As shown in FIG. 6, tips of inner pin contacts 50 may thread through outer insulator 20 when outer insulator 20 is attached to inner insulator 40. Hooks 35 may be configured to contact pin contact outer body 10 when pin contact outer body 10 is attached to inner insulator 40. Pin contact outer body 10 may be configured to enclose outer insulator 20, electromagnetic interference (EMI) shields 30, inner insulator 40, inner pin contacts 50, and at least part of ferrule 60.

Figure 7:
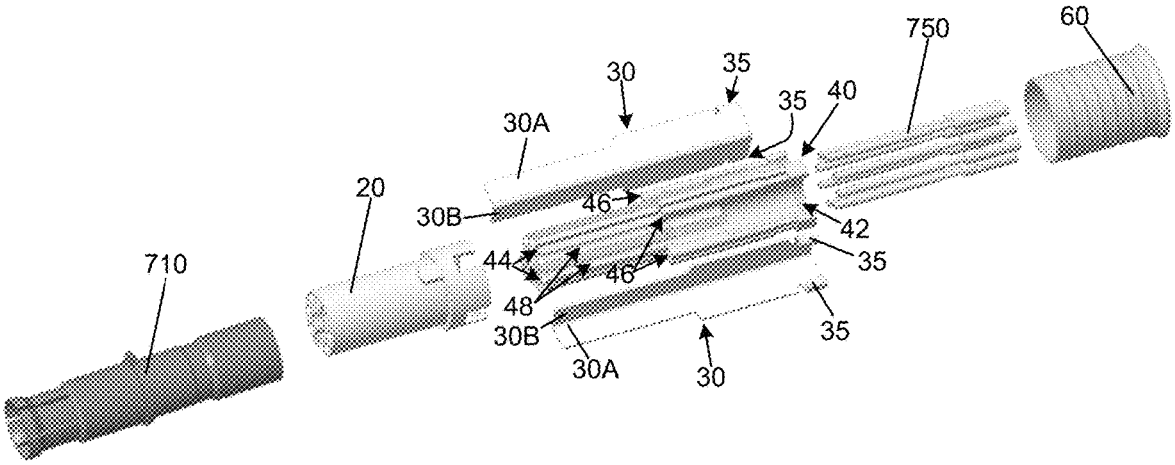
FIG. 7 is a side exploded perspective view of a crosstalk shield system.

FIG. 7 is a side exploded view of a crosstalk shield system, arranged in accordance with at least some embodiments described herein. Those components in FIG. 7 that are labeled identically to components of FIGS. 1-6 will not be described again for the purposes of brevity. System 700 may include a socket contact outer body 710, an outer insulator 20, electromagnetic interference (EMI) shields 30, an inner insulator 40, inner socket contacts 750, and a ferrule 60. Socket contact outer body 710 may be metal, beryllium copper, or copper alloy. Socket contact outer body 710 may be configured to mate with pin contact outer body 10 shown in FIGS. 1 and 6. Inner socket contacts 550 may be metal, beryllium copper, or copper alloy. Inner socket contacts 750 may be configured to mate with inner pin contacts 50 shown in FIGS. 1, 3-6.

Cavities 48 of inner insulator 40 may be configured to secure inner socket contacts 750 to inner insulator 40 when inner socket contacts 750 are inserted into cavities 48. Cavities 48 may be configured to secure two inner socket contacts 750 to inner insulator 40 between each tab 46. As explained in more detail below, EMI shield plates 30 placed within slots 44 of inner insulator 40 may prevent crosstalk between pairs of wires connected to inner socket contacts 750 secured to inner insulator 40.

Figure 8:
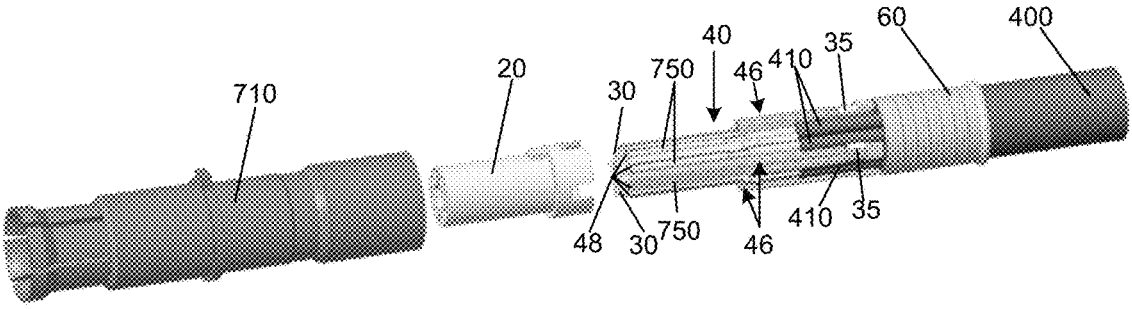
FIG. 8 is a side perspective view of a crosstalk shield system.

FIG. 8 is a side view of a crosstalk shield system, arranged in accordance with at least some embodiments described herein. Those components in FIG. 8 that are labeled identically to components of FIGS. 1-7 will not be described again for the purposes of brevity.

As shown in FIG. 8, ferrule 60 may be placed over a shielding braid of a cable 400. A jacket of cable 400 may be stripped to expose the cable shielding. The shielding braid of cable 400 may be folded back over ferrule 60 to expose wires 410 within cable 400. Wires 410 from within cable 400 may be attached to inner socket contacts 750 on a one to one basis. An untwisted cable pair of wires 410 may be attached to each pair of inner socket contacts 750 and may be secured within a cavity 48 of inner insulator 40. EMI shields 30 within inner insulator 40 may be between and separate the pairs of inner socket contacts 750 and respective untwisted cable pairs of wires 410 from cable 400. EMI shields 30 between pairs of inner socket contacts 750 may prevent electromagnetic interference and crosstalk between untwisted cable pairs of wires 410 from cable 400 connected to the pairs of inner socket contacts 750.

Figure 9:
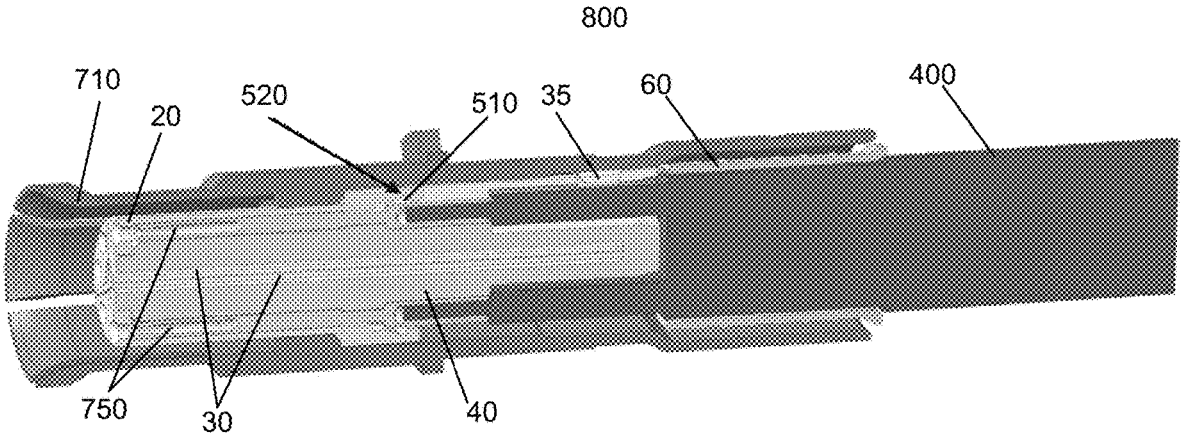
FIG. 9 is a side cutout view of a crosstalk shield system.

FIG. 9 is a side cutout view of a crosstalk shield system, arranged in accordance with at least some embodiments described herein. Those components in FIG. 9 that are labeled identically to components of FIGS. 1-8 will not be described again for the purposes of brevity.

As shown in FIG. 9, tips of inner socket contacts 750 may align with outer insulator 20 when outer insulator 20 is attached to inner insulator 40. Inner socket contacts 750 may not pass through outer insulator 20. Socket contact outer body 710 may enclose outer insulator 20, electromagnetic interference (EMI) shields 30, inner insulator 40, inner socket contacts 750, and most of ferrule 60.

A device in accordance with the present disclosure may prevent crosstalk between pairs of wires in a cable. A device in accordance with the present disclosure may provide an inner insulator and an outer insulator that may be utilized with either an inner pin contact or an inner socket contact. A device in accordance with the present disclosure may reduce costs as the inner insulator, the electromagnetic interference shields, the outer insulator, and the ferrule are common to both a pin configuration and a socket configuration.

Figure 10:
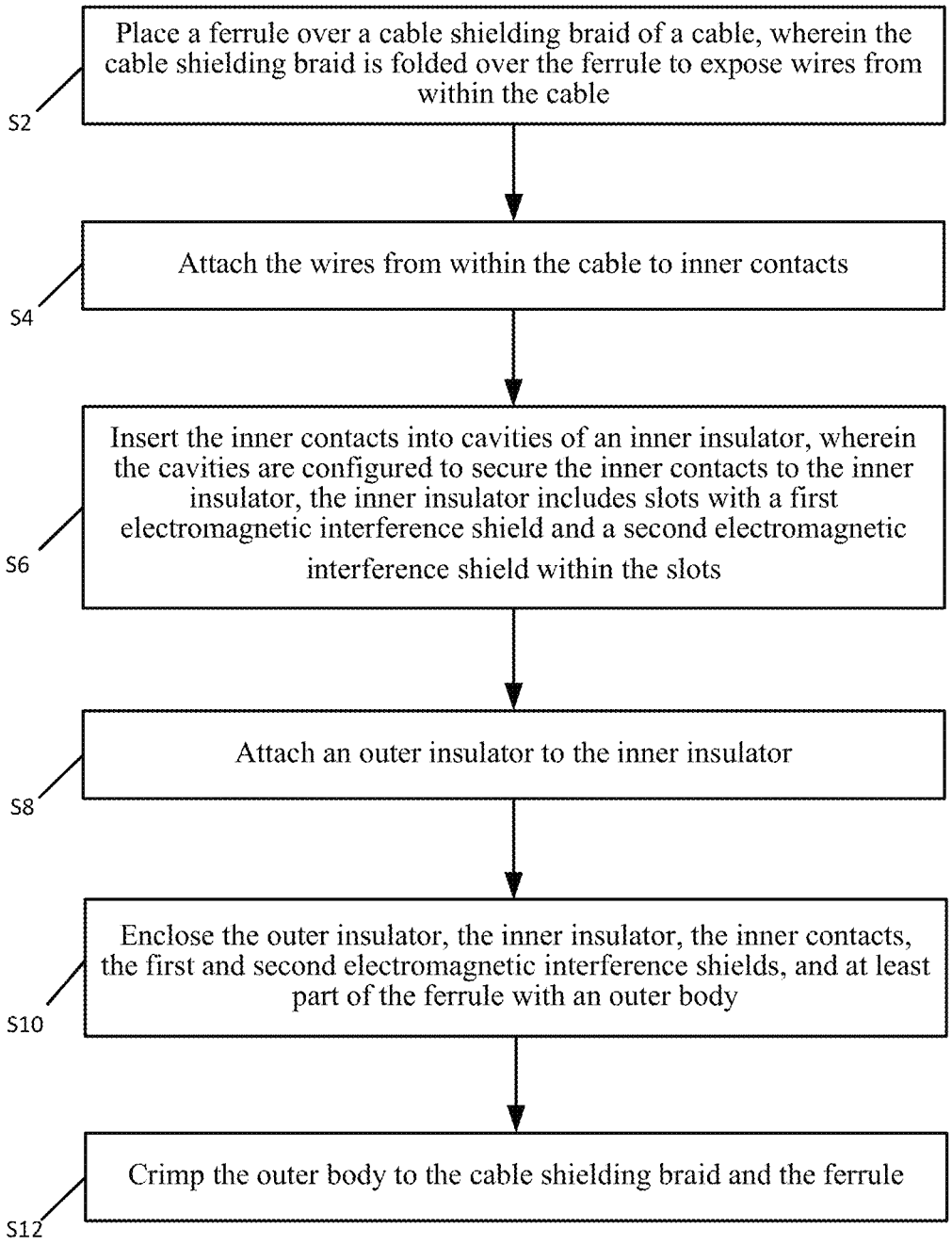
FIG. 10 illustrates a flow diagram for an example process to shield wires from crosstalk, all arranged according to at least some embodiments described herein.

FIG. 10 illustrates a flow diagram for an example process to shield wires from electromagnetic interference, arranged in accordance with at least some embodiments presented herein. An example process may include one or more operations, actions, or functions as illustrated by one or more of blocks S2, S4, S6, S8, and/or S10. Although illustrated as discrete blocks, various blocks may be divided into additional blocks, combined into fewer blocks, or eliminated, depending on the desired implementation.

Processing may begin at block S2, "Place a ferrule over a cable shielding braid of a cable, wherein the cable shielding braid is folded over the ferrule to expose wires from within the cable". At block S2, a ferrule may be placed over a cable shielding braid of a cable. The cable shielding braid may be folded over the ferrule to expose wires from within the cable.

Processing may continue from block S2 to block S4, "Attach wires from within the cable to inner contacts". At block S4, wires from within the cable may be attached to inner contacts. The inner contacts may be inner pin contacts or inner socket contacts. The wires may be twisted cable pairs of wires.

Processing may continue from block S4 to block S6, "Insert the inner contacts into cavities of an inner insulator, wherein the cavities are configured to secure the inner contacts to the inner insulator, the inner insulator includes slots with a first electromagnetic interference shield and a second electromagnetic interference shield within the slots". At block S6, the inner contacts may be inserted into cavities of an inner insulator. The cavities of the inner insulator may be defined by walls of the inner insulator and may be configured to secure the inner contacts to the inner insulator. The inner insulator may include slots with a first electromagnetic interference shield and a second electromagnetic interference shield within the slots. The first electromagnetic interference shield and the second electromagnetic interference shield may each be effective to prevent crosstalk between inner contacts and each may include a first flat plate and a second flat plate connected at a bend.

Processing may continue from block S6 to block S8, "Attach an outer insulator to the inner insulator". At block S8, an outer insulator may be attached to the inner insulator. The inner insulator may include outer insulator retention ribs configured to secure the outer insulator to the inner insulator.

Processing may continue from block S8 to block S10, "Enclose the outer insulator, the inner insulator, the inner contacts, the first and second electromagnetic interference shields, and at least part of the ferrule with an outer body". At block S10, the outer insulator, the inner insulator, the inner contacts, the first and second electromagnetic interference shields, and at least part of the ferrule may be enclosed with an outer body.

Processing may continue from block S10 to block S12, "Crimp the outer body to the cable shielding braid and the ferrule". At block S12, the outer body may be crimped to the cable shielding braid and the ferrule.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. An electrical device to prevent crosstalk, the electrical device comprising:

inner contacts;

a first electromagnetic interference shield and a second electromagnetic interference shield, wherein each electromagnetic interference shield is effective to prevent crosstalk between the inner contacts and includes a first flat plate and a second flat plate connected at a bend with an angle of substantially 90 degrees, and wherein each of the first and second flat plates have a hook at an end thereof;

an inner insulator, wherein the inner insulator includes walls defining slots configured to receive the first and second electromagnetic interference shields and the inner insulator includes walls defining cavities configured to secure the inner contacts to the inner insulator;

an outer insulator, wherein the outer insulator is configured to slide over and attach to the inner insulator;

a ferrule; and an outer body, wherein the outer body is configured to enclose the outer insulator, the inner insulator, the inner contacts, the electromagnetic interference shields, and at least part of the ferrule.

2. The electrical device of claim 1, wherein the inner contact is an inner pin contact.

3. The electrical device of claim 1, wherein the inner contact is an inner socket contact.

4. The electrical device of claim 1, wherein the first and second electromagnetic interference shields are stainless steel or beryllium copper.

5. The electrical device of claim 1, wherein the first electromagnetic interference shield and the second electromagnetic interference shield are placed within the slots of the inner insulator with the angle of the bend between the first flat plate and the second flat plate of the first electromagnetic interference shield opposite the angle of the bend between the first flat plate and the second flat plate of the second electromagnetic interference shield.

6. The electrical device of claim 1, wherein the inner insulator includes four tabs, the electromagnetic interference shields within the slots bisect the tabs, the inner insulator includes walls defining eight cavities configured to secure the inner contacts to the inner insulator, and the cavities are configured to secure two inner contacts between each tab.

7. The electrical device of claim 1, wherein the inner insulator includes retention ribs configured to secure the outer insulator to the inner insulator.

8. An electrical system to prevent crosstalk, the electrical system comprising:

a cable;

inner contacts, wherein the inner contacts are attached to wires from the cable;

a first electromagnetic interference shield and a second electromagnetic interference shield, wherein each electromagnetic interference shield is effective to prevent crosstalk between the inner contacts and includes a first flat plate and a second flat plate connected at a bend with an angle of substantially 90 degrees, and wherein each of the first and second flat plates have a hook at an end thereof;

an inner insulator, wherein the inner insulator includes walls defining slots configured to receive the first and second electromagnetic interference shields and the inner insulator includes cavities configured to secure the inner contacts to the inner insulator;

an outer insulator, wherein the outer insulator is configured to slide over and attach to the inner insulator;

a ferrule, wherein the ferrule is crimped to a shielding braid of the cable and an outer body; and the outer body, wherein the outer body is configured to enclose the outer insulator, the inner insulator, the inner contacts, the electromagnetic interference shields, and at least part of the ferrule.

9. The electrical system of claim 8, wherein the inner contact is an inner pin contact.

10. The electrical system of claim 8, wherein the inner contact is an inner socket contact.

11. The electrical system of claim 8, wherein the first and second electromagnetic interference shields are stainless steel or beryllium copper.

12. The electrical system of claim 8, wherein the first electromagnetic interference shield and the second electromagnetic interference shield are placed within the slots of the inner insulator with the angle of the bend between the first flat plate and the second flat plate of the first electromagnetic interference shield opposite the angle of the bend between the first flat plate and the second flat plate of the second electromagnetic interference shield.

13. The electrical system of claim 8, wherein the inner insulator includes four tabs, the electromagnetic interference shields within the slots bisect the tabs, the inner insulator includes walls defining eight cavities configured to secure the inner contacts to the inner insulator, and the cavities are configured to secure two inner contacts between each tab.

14. A method to prevent crosstalk in an electrical device, the method comprising:

placing a ferrule over a cable shielding braid of a cable, wherein the cable shielding braid is folded over the ferrule to expose wires from within the cable; attaching the wires from within the cable to inner contacts;

inserting the inner contacts into cavities of an inner insulator, wherein the cavities are configured to secure the inner contacts to the inner insulator, the inner insulator includes slots with a first electromagnetic interference shield and a second electromagnetic interference shield within the slots, and the first electromagnetic interference shield and the second electromagnetic interference shield are placed with an angle of substantially 90 degrees between a first flat plate and a second flat plate of the first electromagnetic interference shield, and wherein each of the first and second flat plates have a hook at an end thereof;

attaching an outer insulator to the inner insulator;

enclosing the outer insulator, the inner insulator, the inner contacts, the first and second electromagnetic interference shield plates, and at least part of the ferrule with an outer body; and crimping the outer body to the cable shielding braid and the ferrule.

15. The method of claim 14, wherein the inner contact is an inner pin contact or an inner socket contact.

16. The method of claim 14, further comprising, prior to inserting the inner contacts into the cavities of the inner insulator:

placing the first electromagnetic interference shield plate within the slots of the inner insulator; and placing the second electromagnetic interference shield within the slots of the inner insulator.

17. The method of claim 14, wherein the inner insulator includes four tabs, the electromagnetic interference shields within the slots bisect the tabs, the inner insulator includes walls defining eight cavities configured to secure the inner contacts to the inner insulator, and the cavities are configured to secure two inner contacts between each tab.

* * * * *